US005758469A

United States Patent [19]

George

[11] Patent Number: 5,758,469

[45] Date of Patent: Jun. 2, 1998

[54] AUTOMATED PAIL LIDDING DEVICE

[76] Inventor: Michael John George, 4-6 Thornycroft Street, Campbellfield, Victoria 3061, Australia

[21] Appl. No.: 857,103

[22] Filed: May 15, 1997

[30] Foreign Application Priority Data

Jun. 4, 1996 [AU] Australia ..... PO0255

[51] Int. Cl.[6] ..... B65B 7/28; B67B 3/062; B67B 3/10

[52] U.S. Cl. ..... 53/290; 53/306; 53/329; 53/367

[58] Field of Search ..... 53/290, 306, 321, 53/329, 330, 350, 367

[56] References Cited

U.S. PATENT DOCUMENTS

| | | | |
|---|---|---|---|
| 1,925,117 | 9/1933 | Stoll . | |
| 2,555,194 | 5/1951 | Kojan et al. | 53/329 X |
| 2,997,832 | 8/1961 | Ludwig | 53/306 |
| 5,048,259 | 9/1991 | Cox et al. | 53/306 X |
| 5,426,912 | 6/1995 | Hall et al. | 53/314 |
| 5,533,316 | 7/1996 | Hornsby | 53/329 X |

FOREIGN PATENT DOCUMENTS

| | | |
|---|---|---|
| B-27440/92 | 10/1991 | Australia . |
| 2-117727 | 10/1988 | Japan . |
| 4-44909 | 2/1992 | Japan . |

*Primary Examiner*—Horace M. Culver
*Attorney, Agent, or Firm*—Jensen & Puntigam PS

[57] ABSTRACT

A machine for applying toggle strap fitted lids to open container bodies comprising a lid holding station (1), a container body holding station (2), a lid working means (3) adapted for movement between said lid holding station and said container body holding station and a toggle closing means (21) wherein said lid working means is adapted to pick up a single lid and attached toggle strap from said lid holding station, move from said lid holding station to said container body station, release the toggle strap from said lid while retaining both lid and released toggle strap in substantial juxtaposition, position said lid and released toggle strap onto the open end of a container body positioned on said container body holding station, wherein said toggle closing means closes the released toggle and thereby applies said toggle strap fitted lid to said open container body.

8 Claims, 5 Drawing Sheets

AUTOMATED PAIL LIDDING DEVICE

BACKGROUND

This invention relates to an automated machine adapted for handling pails or other containers which incorporate an over center toggle activated strap for attachment of a lid to said pail. In particular, the invention relates to a machine for applying such lids to such pails in an automated manner.

BACKGROUND TO INVENTION

Larger containers of cylindrical configuration with capacities of 4 litres or upwards which incorporate removable and resealable lids often incorporate cam operated sealing bands or straps to attach the lid to the body of the container. Such straps encircle the perimeter of a lid with a channel shaped band dimensioned to engage the perimeter of a lid whilst simultaneously engaging the top lip of the body of the container. The straps are often operated by an over center toggle fixed to either end of the strap such that upon closing the toggle, the strap is made to close up and tighten over the lid and rim of a container. The advantage of a toggle is its ability to self lock once it is moved over center and once fixed are able to resist working loose. To open such straps, the handle of the toggle is lifted up and once it reaches the central position, will automatically release thereby allowing the whole strap to be removed along with the lid of the container.

Such lidding mechanisms find considerable application in the paint industry where the larger pails of 4 litres or over generally incorporate such a mechanism which facilitates opening and closing of such large paint containers.

However, such mechanisms require a considerable manual input at the stage of filling on an assembly line as no machines currently exist to automatically apply lids which incorporate such toggle straps. Accordingly, such straps are currently manually applied as part of a production line. Furthermore, containers using such mechanisms are supplied as separate empty container bodies and lids where the toggle strap is already applied to the lid per se therefore requiring the operator to firstly remove the toggle strap from the lid, applying the lid to a full container and then finally fitting the toggle strap. Such manual operations are costly, slow, expensive and prone to inflict injury including repetitive strain injury to workers.

OBJECTS AND STATEMENTS OF INVENTION

One object of the invention is to provide a method of automating the handling of containers.

Another object of the invention is to provide a machine for handling containers which is particularly adapted to fitting toggle strapped lids to containers.

In one aspect the invention provides a machine for applying toggle strap fitted lids to open container bodies comprising a lid holding station, a container body holding station, a lid working means adapted for movement between said lid holding station and said container body holding station and a toggle closing means wherein said lid working means is adapted to pick up a single lid and attached toggle strap from said lid holding station, move from said lid holding station to said container body station, release the toggle strap from said lid whilst retaining both lid and released toggle strap in substantial juxtaposition, position said lid and released toggle strap onto the open end of a container body positioned on said container body holding station, wherein said toggle closing means closes the released toggle and thereby applies said toggle strap fitted lid to said open container body.

The lid working means preferably comprises a carriage plate which is adapted for sliding movement between the lid holding station and the container body station and positioned over said lid holding and container stations. The carriage plate may be fitted with a vertically moveable platten adapted to pick up a container lid by vacuum attachment thereto.

The lid holding station preferably comprises at least two lid holding magazines and may be a rotary table which is adapted to position one lid holding magazine at a time underneath the path of the platten.

The container body station is preferably a conveyor adapted for holding and conveying the container bodies past the lid holding station and underneath the path of the platten.

The actions of the lid working means, lid holding station and container body station are all coordinated to provide an automatic cycle of lid fitting to empty containers.

The carriage plate may further comprise a toggle opening means and a toggle register means which are both adapted to co-operate with the platten in such a manner to manipulate the toggle strap of a lid when held by the platten. The platten may further comprise radially operative segment plates which are adapted to retain both the lid and toggle strap in juxtaposition to each other and the platten.

DETAILED DESCRIPTION OF INVENTION

The invention will now be described in greater details with reference to the following particularly preferred embodiments as shown in the following figures.

The machine of the invention is designed to automatically apply lids, with a toggle strap pre-fitted thereto, to open pails or containers which have been filled with the required contents. As such, the machine comprises a number of stations for handling and manipulating the separate lids, pails and toggle straps in a co-ordinated manner so as to receive a continuous supply of open pails and fit lids thereto in an automated and cyclic manner.

Figures 1, 4:
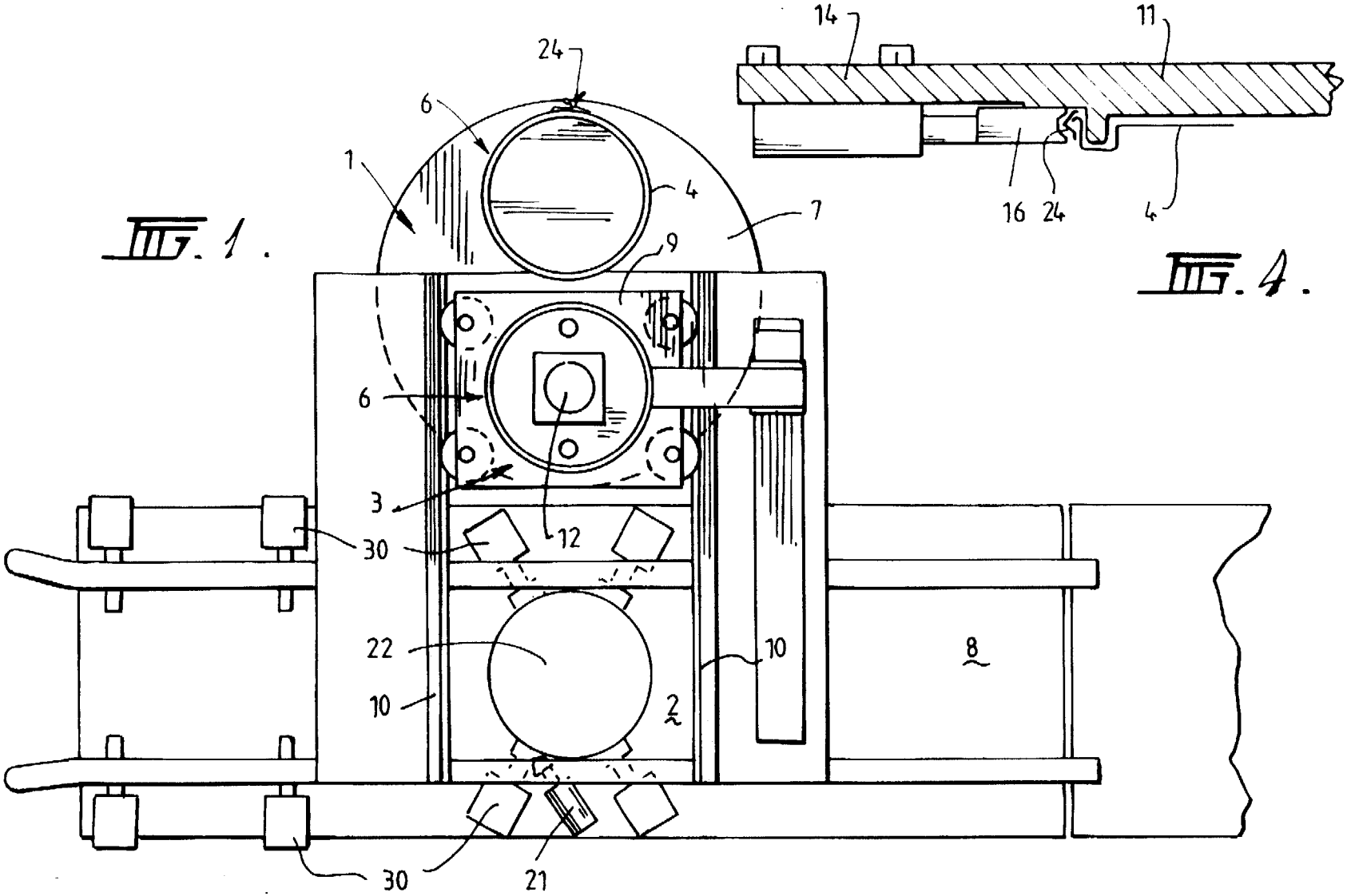
FIG. 1 shows a plan view of the machine.
FIG. 4 shows a cross section of part of the platten detailing one segment plate.
Figure 6:
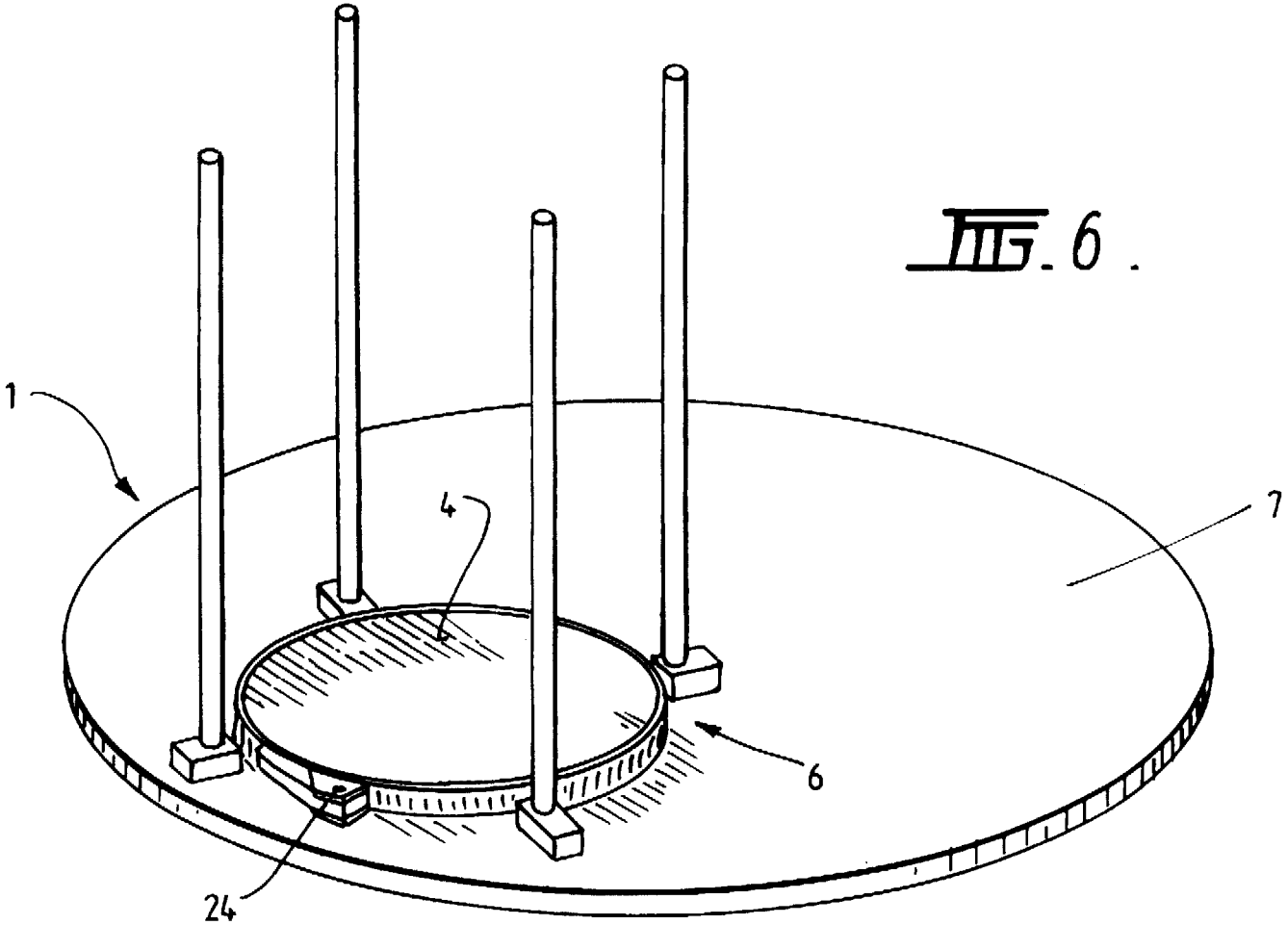
FIG. 6 shows a lid magazine of the lid holding station.

The general layout of the machine is depicted in a plan aspect in FIG. 1. The machine comprises a lid holding station 1 being a rotary table 7 with two lid holding magazines 6. The lid holding magazines can hold a plurality of lids 4 with attached toggle straps 5. In order to ensure that the bulky toggle does not interfere with the level of the lid stack, the lids are stacked in a rotationally alternating manner with the toggles offset to ensure that a stack of lids remains substantially flat within the magazines (see FIG. 6). The lid holding station incorporates two lid magazines to allow simultaneous filling of a first magazine with lids (and attached toggle straps) whilst the second lid magazine is presented to, and interacting with, the lid working means 3.

The container body handling station 2 is positioned adjacent the lid holding station 1 and comprises a conveyor 8 and a plurality of container interrogation and manipulation mechanisms 30 which monitor and control the movement of the containers 22 as they move along the conveyor and bypass the lid holding station.

The lid working means 3 lies at the heart of the machine and is responsible for picking up a lid, (with a toggle strap attached) from the lid magazine 6, moving the lid and toggle strap across to the open container 22 and fitting it thereto. However, in order to achieve this a number of operations must be performed on the lid and toggle strap during transit.

The lid working means comprises a carriage plate 9, platten 11 and a battery of manipulating means (not shown in FIG. 1) all suspended above the lid holding and container body handling stations and adapted to move back and forth along carriage rails 10 from a first position aligned above lid magazines to a second position aligned above the conveyor 8 of the container body holding station.

Figure 2:
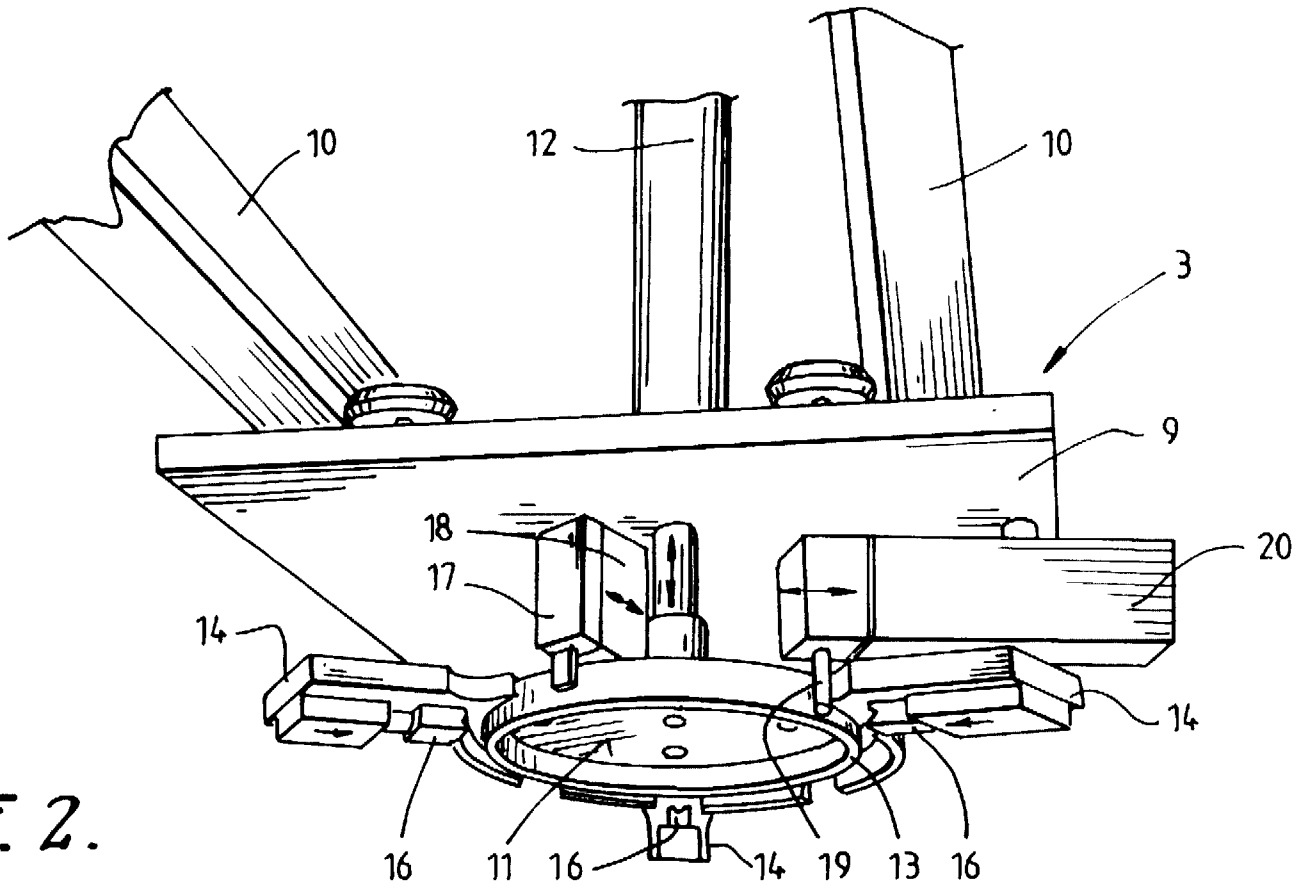
FIG. 2 shows a perspective underview of the lid working means.
Figure 3:
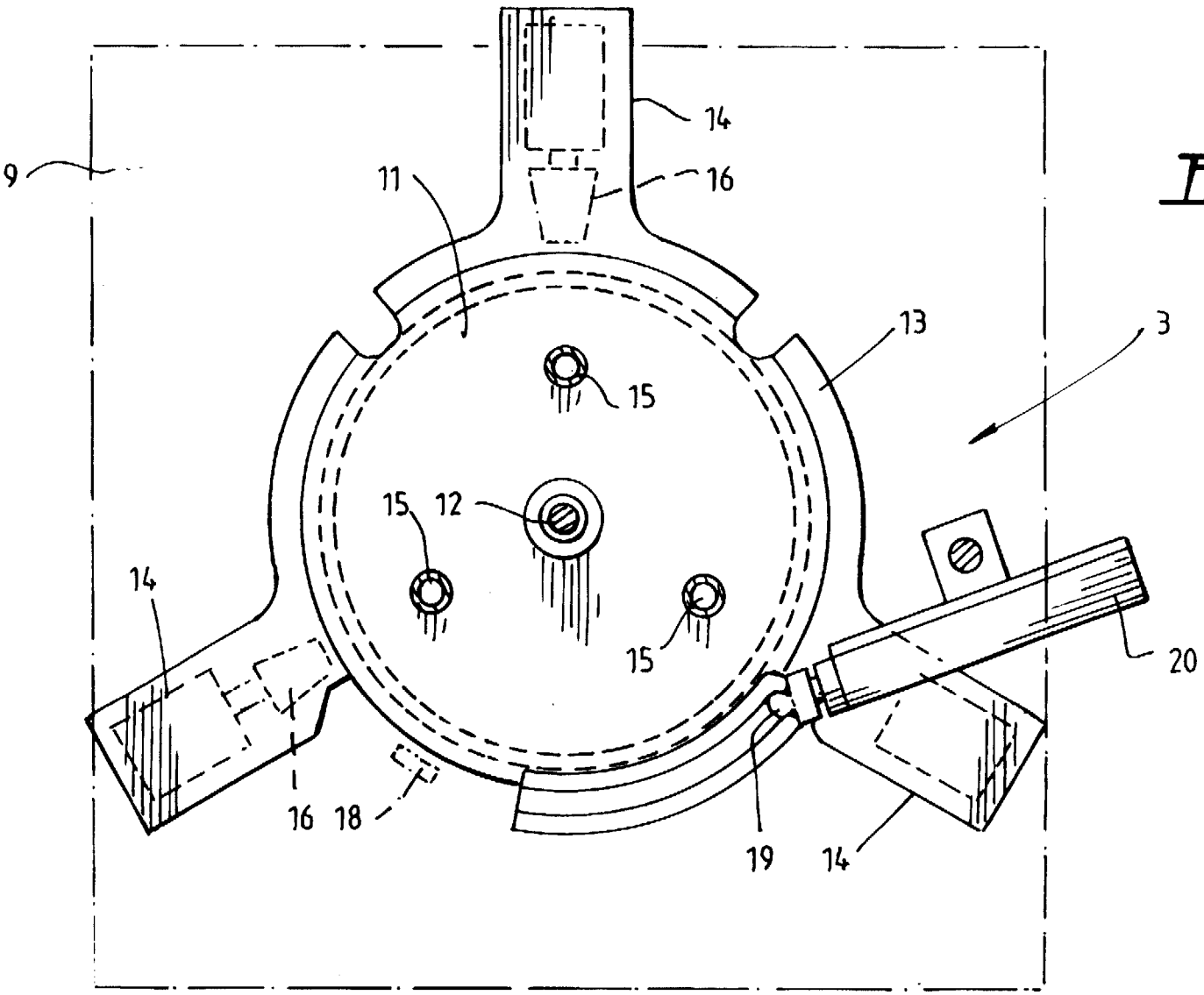
FIG. 3 shows a plan view of the lid working means.

Referring now to FIGS. 2 and 3. FIG. 2 shows the lid working means from underneath with the carriage plate 9 adapted to move back and forth along the carriage rails 10. The carriage plate functions as a chassis and has a platten 11 fitted thereto which is adapted for vertical movement up and down.

The platten is fitted to the carriage plate via a pneumatic cylinder 12 which is adapted to move the platten down and up in a vertical plane as required. The platten is shown in FIG. 2 in a first position abutting its carriage plate. In this first position, the platten is suspended above the lid holding and container loading stations and can freely move from one to the other.

Figure 5:
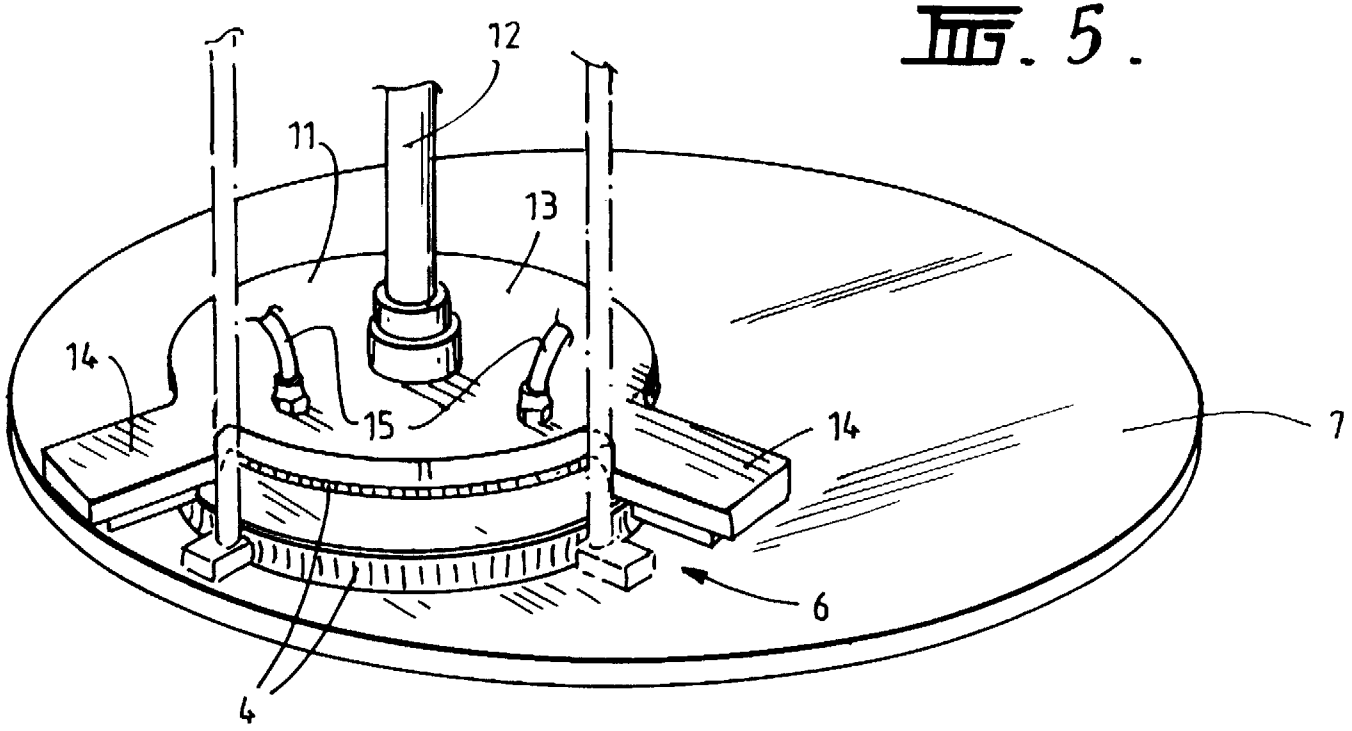
FIG. 5 shows the platten positioned at the lid holding station.

Referring now to FIGS. 2 and 3, the platten has a circular body 13 dimensioned and shaped to conform to the size and configuration of the lids and three radial arms 14 extending out from the periphery of the platten body. The body of the platten has three vacuum holes 15 which are connected to a vacuum pump and serve as the primary means of attaching a lid to the platten body. In the first phase of the cycle, the carriage plate is positioned over one of the lid holding magazines and the platten is lowered onto the stack of lids by the pneumatic cylinder 12 whence the vacuum is applied and the lid is attached to the platten by suction alone (see FIG. 5). The pneumatic cylinder then lifts the platten and attached lid (with toggle strap) up to a first position abutting the carriage plate 9. Referring now to FIG. 4, at this stage the lid 4 is firmly held by the vacuum attachment to the body of the platten 11; however, in order to allow the required opening of the toggle strap 24 and due manipulation of the lid 4, three segment plates 16 adapted to engage the toggle strap are positioned on the three radial arms 14 of the platten.

The segment plates 16 are adapted for radial movement from a first position free of said toggle strap 24 to a second position loosely engaging the toggle strap (as shown in FIG. 4) so as to allow rotation of said strap 24 and lid 4 about the platten whilst maintaining the juxtaposition of said lid and toggle strap.

With the toggle strap loosely engaged by the segment plates, the vacuum is removed and the carriage plate moves from its first position over the lid holding station to its second position over the container body holding station. In a simultaneous action, a lidless container 22 has been moved along the conveyor 8 to a position underneath the lid working means. In order to fit the lid to the container, it is first necessary to release the toggle of the toggle strap as fitted to the lid, and a toggle opening arm is provided for this purpose. However, as previously discussed, the stacking of the toggle strapped lids is arranged alternately with the bulky toggles positioned step wise to facilitate flat stacking of the lids. Accordingly, the lid working means will pick up lids which have been alternately positioned with respect to the circumferential position of the toggle. In order to allow the toggle opening arm to accurately engage the toggle it is necessary for the lid working means to incorporate a toggle register arm 19 operated by a toggle register cylinder 20 which is adapted to act on the toggle strap prior to the toggle release to rotate the toggle strap to a suitable position for toggle release prior to the activation of the toggle opening arm. The toggle register cylinder is fitted to the carriage plate along with the toggle opening cylinder but is pivoted and bias to the center of the platten to ensure constant engagement and faithful rotation of the toggle prior to release.

Once the toggle register arm has rotated the toggle, the vacuum is reapplied to securely hold the lid. From this position, a toggle opening arm 17 is activated to move out radially to engage and push open the toggle of said toggle strap. The toggle opening arm is activated by a toggle opening pneumatic cylinder 18 located on said carriage plate and positioned to co-operate with the toggle of a lid held on the platten. The toggle is released such that the free toggle strap is then held in juxtaposition to the lid by the segment plates, as previously described, and the lid is held to the platten by the vacuum.

The platten is then lowered toward the open container and simultaneously the segment plates are partially released to open up the toggle strap enough to allow the strap to fit over the rim of an open container but not so much to allow the strap to fall out of engagement with the vacuum held lid. Once the platten reaches a third position with the lid snugly abutting the rim of a container, the platten then pushes down to fit the lid to the open container. The segment plates then activate sequentially to progressively close the strap around the lid and container rim. The sequential closing firstly clamps the rear of the strap, being that part of the strap opposite the toggle, to the lid and cylinder rim; then the male end of the toggle strap is clamped followed by the female end of the toggle to ensure the smooth and correct engagement of the free ends of the strap.

Once the strap is clamped in position, the toggle closing means 21 (see FIG. 1) is activated to close the toggle. The vacuum is released and the platten raised. The lidded container is then moved along by the conveyor and the cycle starts again.

In this manner, the machine of the invention can operate as a fully automated central unit in a production line, feeding filled containers without lids and lids with straps attached to the machine of the invention, and allow for the automatic lidding of such containers. As is described in the foregoing, the machine of the invention requires a well coordinated number of actions and the lid holding station, the lid working means and the container body holding station are all coordinated by a plurality of sensors and manipulators attached to the machine at various positions to sense and co-ordinate the action of the containers and of the lids. In one cycle of operation, a filled lidless container would arrive at the conveyor belt and be detected and stopped by the action of the manipulation mechanisms 30 which would function as sensors and/or activating arms that could project into the path of the conveyor belt and hold an empty container. The cycle of the machine will begin only once the lid working means will detect that there is in fact a lid present in one of the lid magazines located directly underneath the lid working means, which, at this stage, is positioned over the top of the lid working means. Once the presence of a lid is confirmed, the container held on the conveyor belt will be released and moved down to the next position directly under the path of the carriage plate. Simultaneously, the lid working means will lower the platten via the pneumatic cylinder down onto the top of the available lid and the vacuum of the platten will be activated and the lid sucked up for attachment to the platten. The pneumatic cylinder will then move up lifting the lid with its attached toggle strap to abut the carriage plate being suspended over both the lid holding and container stations. The lid is then firmly held by the suction cylinders and the three segment plates then converge radially in towards the lid and loosely hold the toggle strap and lid whilst the suction is maintained. The suction is then released only enough to allow the lid and the toggle strap to be rotated. The carriage plate then moves across into the path of the conveyor and simultaneously the toggle register arm is activated to rotate the toggle strap to a reference or known position in order to align the toggle for engagement by the toggle release arm. Once the toggle register cylinder has in fact moved the toggle around to the correct position, the vacuum is then re-established to tightly hold the lid and the toggle release arm is activated thereby releasing the toggle and the strap which is then held by virtue of the segment plates which are not moved and in a position to hold the strap in correct juxtaposition to the lid. At this stage, the lid working means is moved directly over the path of the conveyor and the container which is held underneath. The next stage involves the activation of the platten cylinder and the movement of the platten with its attached lid and toggle strap down onto the rim of the filled lidless container. The platten is pushed down onto the cylinder rim using a predetermined pressure sufficient to seal the lid and to push the lid into a correctly aligned position in relation to the rim of the container. Once the predetermined pressure is reached, the strap and toggle are ready to be re-fitted to the lid and to embrace the rim of the container. In order to ensure that the toggle strap fits correctly, the three segment plates are activated in a coordinated fashion with the first segment plate pushing radially inwards to securely abut the rear of the strap to the lid and rim of the cylinder. Whilst it is being held in place, the next segment plate is activated to move radially inwards to push the male end of the strap onto the lid and rim of the cylinder and finally, the last segment plate is moved radially inwards to push the female end of the strap onto the lid and cylinder rim and at the same time over the top of the male end of the strap. The next stage involves the activation of the toggle closing means which is a pneumatically operated ram positioned to move across the open toggle and closing the toggle against the strap thereby sealing the cylinder with the lid and toggle strap completely attached. At this stage, the cylinder closing the toggle, confirms that the action is completed and the cycle finished and if another cylinder is available at the beginning of the conveyor, the whole cycle will begin again.

The machine further incorporates full pneumatic operation of all the component parts to ensure that there is no danger of electrical short circuits or sparks which could jeopardise the handling of volatile solvents and explosive contents for the containers. The machine of the invention offers for the first time a fully automated integral unit for the lidding of open containers or pails with the use of toggle strap fitting means. The machine provides vastly improved efficiencies and safety for workers in the field.

I claim:

1. A machine for applying toggle strap fitted lids to open container bodies comprising a lid holding station, a container body holding station, a lid working means adapted for movement between said lid holding station and said container body holding station and a toggle closing means wherein said lid working means is adapted to pick up a single lid and attached toggle strap from said lid holding station, move from said lid holding station to said container body station, release the toggle strap from said lid whilst retaining both lid and released toggle strap in substantial juxtaposition, position said lid and released toggle strap onto the open end of a container body positioned on said container body holding station, wherein said toggle closing means closes the released toggle and thereby applies said toggle strap fitted lid to said open container body.

2. A machine according to claim 1 where said lid working means comprises a carriage plate which is adapted for sliding movement between the lid holding station and the container body station and positioned over said lid holding and container stations.

3. A machine according to claim 2 wherein said lid holding station comprises at least two lid holding magazines.

4. A machine according to claim 2 wherein said carriage plate is fitted with a vertically moveable platten adapted to pick up a container lid by vacuum attachment thereto.

5. A machine according to claim 4 wherein the said lid holding station is a rotary table which is adapted to position one of said lid holding magazines at a time underneath the path of the platten.

6. A machine according to claim 5 wherein said container body station incorporates a conveyor adapted for holding and conveying the container bodies past said lid holding station and underneath the path of the platten.

7. A machine according to claim 6 wherein said carriage plate further comprises a toggle opening means and a toggle register means which are both adapted to co-operate with the platten in such a manner as to manipulate the toggle strap of a lid when held by the platten.

8. A machine according to claim 7 wherein said platten further comprises radially operative segment plates which are adapted to retain both the lid and toggle strap in juxtaposition to each other and the platten.

* * * * *